US005630701A

United States Patent [19]

Lawer

[11] Patent Number: 5,630,701

[45] Date of Patent: May 20, 1997

[54] VARIABLE ANGLE VANE ARRAYS

[75] Inventor: Steven D. Lawer, Derby, England

[73] Assignee: Rolls-Royce plc, London, England

[21] Appl. No.: 628,155

[22] Filed: Apr. 5, 1996

[30] Foreign Application Priority Data

Jun. 5, 1995 [GB] United Kingdom ..... 9511269

[51] Int. Cl.[6] ..... F01D 17/16

[52] U.S. Cl. ..... 415/160

[58] Field of Search ..... 415/150, 159, 415/160, 162

[56] References Cited

U.S. PATENT DOCUMENTS

| | | | |
|---|---|---|---|
| 4,710,097 | 12/1987 | Tinti . | |
| 4,732,536 | 3/1988 | Lejars et al. | 415/160 |
| 5,277,544 | 1/1994 | Naudet | 415/160 |

FOREIGN PATENT DOCUMENTS

| | | |
|---|---|---|
| 0209428 | 1/1987 | European Pat. Off. . |
| 0536045 | 4/1993 | European Pat. Off. . |
| 1064089 | 4/1967 | United Kingdom . |
| 1324385 | 7/1973 | United Kingdom . |
| 1492390 | 11/1977 | United Kingdom . |

*Primary Examiner*—Edward K. Look
*Assistant Examiner*—Mark Sgantzos
*Attorney, Agent, or Firm*—Cushman Darby & Cushman, IP Group of Pillsbury Madison & Sutro LLP

[57] ABSTRACT

A power turbine includes pivotable vanes for a variable area nozzle which are accurately and consistently assembled in a first full throat area position by providing an abutment and an abutment surface on gear segment arms attached to spindles at the radially outermost ends of the vanes. When the first vane has been fitted in the 100% throat position by threading its aerofoil portion through a slotted aperture in the turbine casing 10, the remaining vanes are accurately angularly positioned by causing their abutments to abut the abutment surface on the previously fitted vane segment arm.

15 Claims, 1 Drawing Sheet

VARIABLE ANGLE VANE ARRAYS

FIELD OF THE INVENTION

The present invention concerns variable angle vane arrays in axial fluid flow machines. It is particularly, but not exclusively, concerned with variable area nozzle vane arrays suitable for use in power turbines forming part of gas turbine engines of the kind utilised in industrial and marine environments, for example the propulsion of ships.

The invention could also be utilised in gas turbine engines of the kind which power aircraft, though weight and space penalties might be engendered.

BACKGROUND OF THE INVENTION

Due to the need to optimise performance of power turbines in gas turbine engines, a nozzle vane array which directs a working fluid onto the power turbine rotor blades should have the capability of varying its nozzle area. This can be achieved by pivoting the vanes in unison about axes extending radially of the turbine. By this means, the total throat area of the nozzle can be varied between maximum and minimum scheduled values during normal operation of the engine.

In an emergency, such as turbine shaft breakage, leading to overspeed of the power turbine, it is highly desirable to have the capability of effecting substantially total obturation (i.e., shut-down) of the nozzle. This action substantially prevents the working fluid impinging on the turbine blades, thereby avoiding freewheeling runaway of the rotating parts of the turbine and consequent failure due to excessive centrifugally induced stresses.

During assembly of the variable area nozzle, it is vital that the vanes and their actuating mechanism are set up so that when the vanes are pivoted to vary the total nozzle exit area during normal operation, the correct vane angles are selected to ensure that variations in nozzle exit flow area do not occur circumferentially around the array of vanes; i.e., the throat areas between adjacent vanes should be substantially identical for all vane pairs. If incorrect vane angles are selected, there may be unacceptable deviation from expected power turbine performance, or even damage to the turbine if the vane angles are very incorrect.

SUMMARY OF THE INVENTION

The present invention seeks to provide an improved variable area nozzle vane assembly suitable for an axial flow power turbine, the improvement residing in structural features facilitating accurate assembly of the variable area nozzle in the power turbine structure.

According to the present invention, a variable angle vane assembly comprises;

an array of pivotable aerofoil-shaped vanes, a casing ring having a circumferential array of apertures therein, each vane being pivotally supported in the casing ring to protrude inwardly of the casing ring from a respective aperture, and drive means on a radially outer end of each vane for effecting pivoting movement thereof, wherein;

the vanes and apertures are configured and dimensioned with respect to each other so as to allow and dictate the passing through each aperture of a respective vane in an attitude which corresponds to an extreme position in a range of pivoting movement of the vane, and each drive means includes abutments located thereon such that after a first vane is passed through an aperture and fitted in the extreme position, adjacent vanes can only be fitted if abutments on the adjacent vanes' drive means are in contact with each other.

In a preferred embodiment of the invention, each drive means comprises a gear segment lever arm secured to the radially outer end of each vane. A toothed unison ring meshes with the toothed rim of each gear segment for simultaneous transmission of turning movement to each vane through their respective gear segments. When, during assembly of the variable area nozzle, the first vane is inserted through the aperture in the casing ring, correct alignment is facilitated because the clearances between the extreme radially outer portion of the vane's aerofoil and the aperture in the casing ring are less than one pitch of the gear teeth on the gear segments and the unison ring.

Preferably, the abutments comprise a contact face on an end of each gear segment's toothed rim and a contact face on an opposed side of each respective lever arm, whereby when the vanes are in the above-mentioned extreme position, the contact face on the end of each gear segment's toothed rim abuts or closely confronts the contact face on the side of the adjacent gear segment's lever arm. Hence, after the first vane assembly is fitted, comprising a vane with its attached gear segment, subsequent vane assemblies can only be pushed through the slots to their final position in the array if the correct gear teeth on the gear segments and the unison ring are engaged, so enabling installation of all the vanes at an exact desired common angle.

BRIEF DESCRIPTION OF THE DRAWINGS

The invention will now be described, by way of example and with reference to the accompanying drawings, in which.

DETAILED DESCRIPTION OF THE INVENTION

Figure 1:
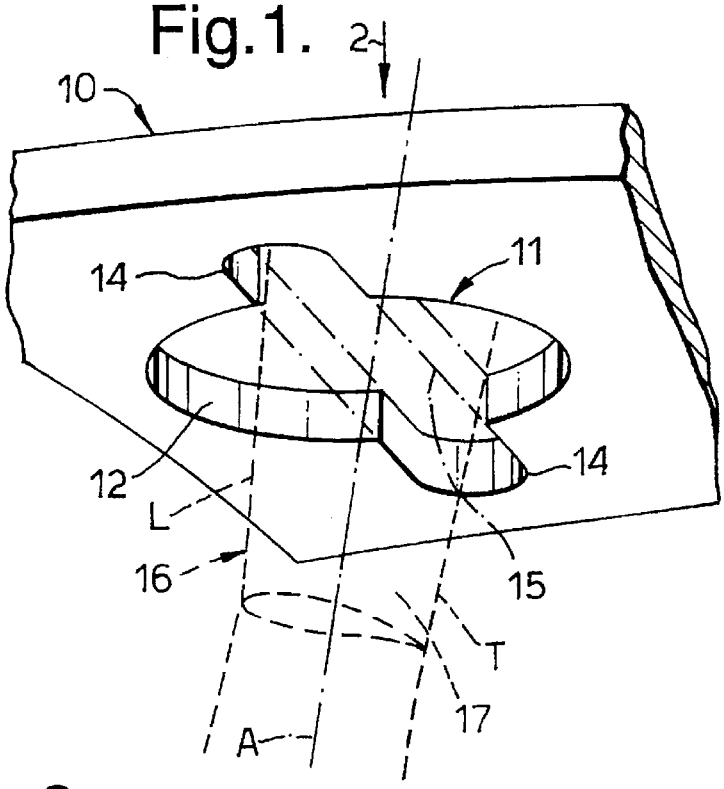
FIG. 1 is a pictorial part view of a power turbine casing in accordance with the present invention.
Figure 2:
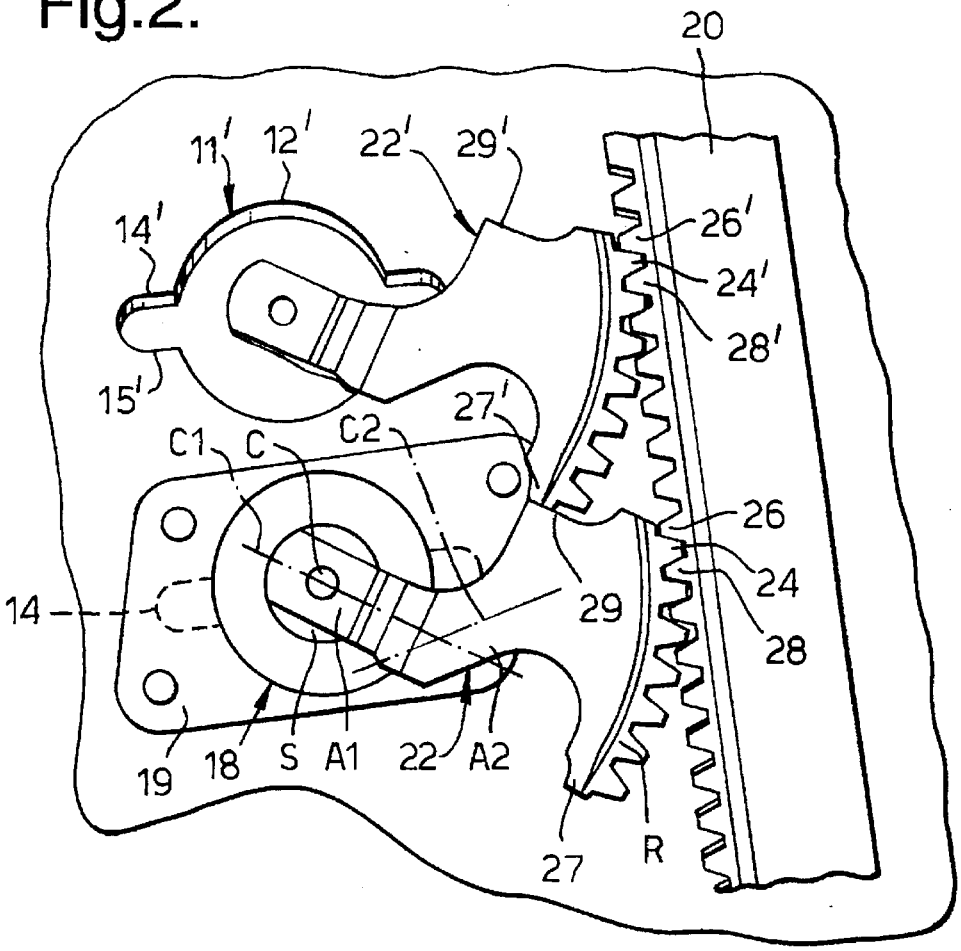
FIG. 2 is a view in the direction of arrow 2 in FIG. 1 and includes vane turning apparatus.

Referring to FIGS. 1 and 2, a turbine casing ring 10, only a small portion of which is shown, has a circumferential array of apertures 11 therein. Only one aperture 11 is shown in FIG. 1, but in FIG. 2, an adjacent aperture 11' is shown. Apertures 11 comprise holes 12 drilled or otherwise cut through the casing, all being equi-angularly spaced about the casing axis, each hole 12 being provided with cut-out slot portions 14 on diametrically opposing sides, e.g., by a milling or grinding process, so as to effectively form a diametrically extending slot 15.

During construction of the turbine, vanes 16 can only be inserted through the turbine casing 10 by engaging the leading and trailing edges L,T of their aerofoil portions 17 with the slots 15, i.e. cut-outs 14, and pushing the vanes radially inwards. The vanes 16 have spindles S at their outer ends (shown only in plan view in FIG. 2) and after being pushed fully home, each vane 16 is supported by its spindle S in a bearing and sealing assembly 18 for pivoting movement about an approximately radially extending pivot axis A. This bearing and sealing assembly 18 also obturates the hole and slot arrangement 12,15 and has a housing 19 which is bolted to the casing 10 to secure the assembly.

The vanes and slots are judiciously configured and dimensioned with respect to each other. In particular, each slot 15 is aligned and shaped so as to only accept the radially inner end of a vane's aerofoil portion when that vane is presented in an attitude which closely approximates its attitude in one extreme part of its operational pivotal movement. Preferably this attitude is the one which along with the other vanes, provides the maximum desired throat area of the stage of vanes 16. However, the expert in the field will appreciate that the vane attitude could be that at the other end extremity of pivotal movement, provided that undue weakening of the casing ring 10 did not occur due to the need to align the slots 15 in or near the circumferential direction.

In FIG. 2, a unison ring 20 (a device well known in the field) is provided and connected to turn the vanes 16 simultaneously via lever arms 23 in the form of gear segments. One segment gear 22 is provided for each vane 16, though only two neighbouring segments are shown in the Figure.

On completion of insertion of the first vane 16 through the slot 15 as described hereinbefore, final positioning of that vane—within small clearances in the engagement of the aerofoil's radially outer leading and trailing edges L, T, with the cut-outs 14—is achieved when the tooth 24 of the associated segment gear 22, which is the leading tooth in the present arrangement when the vanes 16 are pivoted from maximum area to minimum area, begins to pass into the space between two teeth 26, 28 on the unison ring 20. Correct alignment of the first vane sub-assembly to the fully open position is assisted because the clearance between the extreme radially outer part of the aerofoil and the cut-outs 14 is less than one pitch of the gear teeth on the segments 22 and the unison ring 20. Furthermore, gear teeth correlation markings can also be provided to confirm correct installation position of the vane.

To enable easy and consistent installation of subsequent vanes, each segment gear 22 is specially shaped so that in plan view it presents a "cranked" appearance. The crank appearance is obtained because the rim R of each gear segment 22 is joined to its centre C by a lever arm 23 having an inner arm portion A1 whose longitudinal centreline C1 has a radial orientation with respect to the toothed rim R and an outer arm portion A2 whose longitudinal centreline C2 has a non-radial skewed orientation with respect to the toothed rim. One end of the gear segment's rim R provides an abutment or contact face 27, whereas an opposing side of the outer arm portion A2 is formed with a shoulder portion which provides a further abutment or contact face 29. Abutment 29 is engaged by the rim abutment 27' of an adjacent segment gear 22' as follows.

On inserting a second vane (not shown) through a slot 15' adjacent the slot 15 containing the first fitted vane 16, a substantially correct attitude of the second vane is initially achieved by engagement of the vane's aerofoil with the slot, as described above for the first vane. As was the case for the first vane, final attitude is achieved when the second vane's bearing assembly (not shown) locates in hole 12' and is fixed therein. At this point, leading tooth 24' on the vane's attached gear segment 22' locates between two teeth 26',28', on the unison ring 20. Correct positioning is assured without further checking when the abutment 27' engages the abutment 29 on the first fitted vane segment gear 22—or at least, taking account of manufacturing tolerances, lies very closely adjacent thereto.

All of the remaining vanes are fitted in sequence as described in connection with the second vane, and when the last vane in the stage is fitted, along with its associated bearing and segment gear, its rim end abutment 27 and side abutment 29 engage and are engaged by the appropriate features 29 and 27 respectively on the first fitted segment gear 16 and last but one fitted segment gear.

The invention described hereinbefore ensures that all of the vanes 16 are correctly angularly aligned and are moved in unison through identical magnitudes of arc, thus maintaining common throat areas between each adjacent pair of vanes 16 around the turbine annulus.

Although the above exemplary embodiment has been concerned with a variable nozzle vane assembly for use with a power turbine, it could also be applicable to variable vanes used in other types of turbines or in compressors.

I claim:

1. A variable area vane assembly comprising;

a casing ring having an axis and a circumferential array of apertures therein, a plurality of pivotable aerofoil shaped vanes, each vane being pivotally supported in the casing ring about a radial axis to protrude radially inwardly of the casing ring from a respective aperture, the vanes being pivotable between a first extreme position giving maximum fluid flow delivery and a second extreme position giving minimum fluid flow delivery, each vane having a radially outer end, drive means on a radially outer end of each vane for effecting pivoting movement thereof, each said vane having a leading and trailing edge and each said aperture in said casing ring having spaced apart slots shaped to receive respectively said leading and trailing edges of a said vane at an orientation such that said respective vane will extend in an attitude that corresponds to one of said first and second extreme positions in the range of pivoting movements of the respective vane, each drive means including at least one abutment located to engage with a portion of an adjacent drive means after a first vane is passed through an aperture in said casing ring and located in one of said extreme positions and the adjacent vane, upon insertion in a respective aperture in said casing ring, being constrained to assume the same one of said extreme positions in the range of pivoting movements by contact between a portion of said adjacent vane with said respective abutment of said first vane.

2. A gas turbine engine including a casing ring having an axis and a circumferential array of apertures therein, a plurality of pivotable aerofoil shaped vanes, each vane being pivotally supported in the casing ring about a radial axis to protrude radially inwardly of the casing ring from a respective aperture, the vanes being pivotable between a first extreme position giving maximum fluid flow delivery and a second extreme position giving minimum fluid flow delivery, each vane having a radially outer end, drive means on a radially outer end of each vane for effecting pivoting movement thereof, each said vane having a leading and trailing edge and each said aperture in said casing ring having spaced apart slots shaped to receive respectively said leading and trailing edges of a said vane at an orientation such that said respective vane will extend in an attitude that corresponds to one of said first and second extreme positions in the range of pivoting movements of the respective vane, each drive means including at least one abutment located to engage with a portion of an adjacent drive means after a first vane is passed through an aperture in said casing ring and located in one of said extreme positions and the adjacent vane, upon insertion in a respective aperture in said casing ring, being constrained to assume the same one of said extreme positions in the range of pivoting movements by contact between a portion of said adjacent vane with said respective abutment of said first vane.

3. A power turbine including a casing ring having an axis and a circumferential array of apertures therein, a plurality of pivotable aerofoil shaped vanes, each vane being pivotally supported in the casing ring about a radial axis to protrude radially inwardly of the casing ring from a respective aperture, the vanes being pivotable between a first extreme position giving maximum fluid flow delivery and a second extreme position giving minimum fluid flow delivery, each vane having a radially outer end, drive means on a radially outer end of each vane for effecting pivoting movement thereof, each said vane having a leading and trailing edge and each said aperture in said casing ring having spaced apart slots shaped to receive respectively said leading and trailing edges of a said vane at an orientation such that said respective vane will extend in an attitude that corresponds to one of said first and second extreme positions in the range of pivoting movements of the respective vane, each drive means including at least one abutment located to engage with a portion of an adjacent drive means after a first vane is passed through an aperture in said casing ring and located in one of said extreme positions and the adjacent vane, upon insertion in a respective aperture in said casing ring, being constrained to assume the same one of said extreme positions in the range of pivoting movements by contact between a portion of said adjacent vane with said respective abutment of said first vane.

4. A variable area vane comprising an aerofoil shaped portion, a spindle for pivotally mounting the vane in a casing ring and a gear segment removably secured to the spindle, the gear segment having a toothed rim, the toothed rim having first and second ends, the gear segment having a contact face on the first end of the toothed rim and a contact face on an opposite side of the gear segment.

5. An assembly as claimed in claim 1, wherein the drive means comprises a gear segment with a toothed rim, the teeth of which engage with corresponding teeth on a unison ring.

6. An assembly as claimed in claim 5, wherein clearances between the radially outermost parts of the aerofoil portions of the vanes and the apertures in the casing ring are less than one pitch of the gear teeth on the gear segments and the unison ring.

7. An assembly as claimed in claim 5, in which the abutments comprise a contact face on an end of each gear segment's toothed rim and a contact face on an opposed side of each respective segment, whereby when the vanes are in the extreme position, the contact face on the end of each toothed rim at least closely confronts the contact face on the side of the adjacent gear segment.

8. An assembly as claimed in claim 1 wherein said one extreme vane position is the first extreme position which provides maximum throat area of the variable area vanes.

9. An assembly as claimed in claim 1, wherein each aperture has at least one cut-out portion to form a radially extending slot.

10. An assembly as claimed in claim 9, wherein each aperture has two cut-out portions to form a diametrically extending slot.

11. An assembly as claimed in claim 9 wherein the diametrically extending slot extends substantially axially of the casing ring.

12. An assembly as claimed in claim 5 wherein each said vane includes a spindle at a radially outer end thereof and the gear segment comprises an inner portion and an outer portion connecting the spindle and the toothed rim, the inner and outer portions being arranged to give the gear segment a cranked shape.

13. An assembly as claimed in claim 1, wherein a plurality of bearing and sealing assemblies being removably secured to the casing ring, each vane being pivotally supported in a respective one of the bearing and sealing assemblies, each bearing and sealing assembly obturating a respective one of the apertures.

14. A variable vane as claimed in claim 4 wherein the gear segment comprises an inner portion and an outer portion connecting the spindle and the toothed rim, the inner and outer portions being arranged to give the gear segment a cranked shape.

15. A variable vane as claimed in claim 14 wherein the contact face on the opposite side of the gear segment is on the outer portion of the gear segment.

* * * * *